US010240276B2

(12) United States Patent
Ryoo et al.

(10) Patent No.: US 10,240,276 B2
(45) Date of Patent: Mar. 26, 2019

(54) CLOTHES TREATING APPARATUS WITH HEAT PUMP CYCLE AND METHOD FOR CONTROLLING THE SAME

(71) Applicant: LG Electronics Inc., Seoul (KR)

(72) Inventors: Byeongjo Ryoo, Seoul (KR); Jongseok Kim, Seoul (KR); Yongju Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 584 days.

(21) Appl. No.: 14/940,600

(22) Filed: Nov. 13, 2015

(65) Prior Publication Data

US 2016/0145793 A1 May 26, 2016

(30) Foreign Application Priority Data

Nov. 20, 2014 (KR) ..... 10-2014-0162764

(51) Int. Cl.
*F26B 3/00* (2006.01)
*D06F 58/20* (2006.01)
(Continued)

(52) U.S. Cl.
CPC ..... *D06F 58/206* (2013.01); *D06F 58/24* (2013.01); *D06F 2058/287* (2013.01); *D06F 2058/2819* (2013.01)

(58) Field of Classification Search
CPC ... D06F 58/206; D06F 58/24; D06F 2058/287
(Continued)

(56) References Cited

U.S. PATENT DOCUMENTS 7,055,262 B2 * 6/2006 Goldberg ..... D06F 58/206 34/108
2005/0066538 A1 3/2005 Goldberg et al.
2015/0259847 A1 * 9/2015 Kohavi ..... F16L 53/00 34/468

FOREIGN PATENT DOCUMENTS

CN 1695029 11/2005
CN 10-2112677 6/2011
(Continued)

OTHER PUBLICATIONS

Chinese Office Action dated Jun. 12, 2017 issued in Application No. 201510811238.7 (English translation attached).
(Continued)

*Primary Examiner* — John McCormack
(74) *Attorney, Agent, or Firm* — Ked & Associates, LLP

(57) ABSTRACT

A clothes treating apparatus that includes a heat pump cycle and a dehumidifying device is provided herein. The clothes treating apparatus may include a case and a drum installed within the case and configured to accommodate an item for drying. A circulation duct may be provided to form an air circulation flow channel that allows air to circulate through the drum. The heat pump cycle may include an evaporator and a condenser disposed to be spaced apart from one another within the circulation duct, the heat pump cycle being configured to absorb heat of air released from the drum through the evaporator and transmit the absorbed heat to air introduced to the drum through the condenser, by using a working fluid that circulates by way of the evaporator and the condenser. Moreover, the dehumidification device may be provided to dehumidify air passing through the evaporator in the circulation duct.

20 Claims, 6 Drawing Sheets

(51) Int. Cl.
*D06F 58/24* (2006.01)
*D06F 58/28* (2006.01)

(58) Field of Classification Search
USPC ..... 34/468, 469, 471
See application file for complete search history.

(56) References Cited

FOREIGN PATENT DOCUMENTS

| | | | | |
|---|---|---|---|---|
| CN | 10-2560988 | | | 7/2012 |
| CN | 10-2803882 | | | 11/2012 |
| DE | 10-2007-027866 | A1 | | 12/2008 |
| EP | 1550829 | A1 | | 7/2005 |
| EP | 2573252 | A1 | | 3/2013 |
| EP | 2692940 | A1 | | 2/2014 |
| JP | 2007-105209 | A | | 4/2007 |
| JP | 2007105209 | A | * | 4/2007 |
| JP | 2008-029654 | A | | 2/2008 |
| JP | 2008-048810 | A | | 3/2008 |
| JP | 2008-272137 | A | | 11/2008 |
| JP | 2010-281500 | A | | 12/2010 |
| KR | 10-2006-0083424 | A | | 7/2006 |
| KR | 10-2011-0019095 | A | | 2/2011 |

OTHER PUBLICATIONS

European Search report dated Jan. 11, 2016 issued in Application No. 15194714.0.

* cited by examiner

CLOTHES TREATING APPARATUS WITH HEAT PUMP CYCLE AND METHOD FOR CONTROLLING THE SAME

CROSS-REFERENCE TO RELATED APPLICATION(S)

This application claims priority under 35 U.S.C. § 119 to Korean Application No. 10-2014-0162764 filed in Korea on Nov. 20, 2014, whose entire disclosure is hereby incorporated by reference.

BACKGROUND

1. Field

The present disclosure relates to a clothes treating apparatus with a heat pump cycle, and particularly, to a clothes treating apparatus capable of increasing a dehumidifying capability and stabilizing a cycle.

2. Background

Clothes treating apparatuses with heat pump cycles are known. However, they suffer from various disadvantages.

BRIEF DESCRIPTION OF THE DRAWINGS

The embodiments will be described in detail with reference to the following drawings in which like reference numerals refer to like elements wherein.

DETAILED DESCRIPTION

Description will now be given in detail of the exemplary embodiments, with reference to the accompanying drawings. For the sake of brief description with reference to the drawings, the same or equivalent components will be provided with the same reference numbers, and description thereof will not be repeated.

Hereinafter, the present disclosure will be described in detail with reference to the accompanying drawings, in which like numbers refer to like elements throughout although the embodiments are different. As used herein, the singular forms "a", "an" and "the" are intended to include the plural forms as well, unless the context clearly indicates otherwise.

In general, a clothes treating apparatus having a drying function such as a washing machine or a dryer is a device in which the laundry which has been completely washed and spin-dried is applied to the interior of a drum, and forced hot air is supplied to the interior of the drum to vaporize moisture of the laundry to dry the laundry.

A clothes dryer may be classified as an exhaust type clothes dryer and a condensing type clothes dryer according to schemes of processing humid air which has passed through the drum after the laundry is dried.

The exhaust type clothes dryer exhausts humid (or damp) air discharged after passing through the drum to the outside of the dryer, and the condensing type clothes dryer cools humid air to below a dew point through a condenser through circulation to condense moisture included in the humid air, rather than exhausting the humid air discharged from the drum to the outside of the dryer.

In the condensing type clothes dryer, before condensate condensed in the condenser is re-supplied to the drum, the condensate is heated by a heater and heated air is introduced to the drum. Here, the humid air is cooled in the process of being condensed, causing loss of thermal energy, and thus, in order to heat the air to a temperature required for drying, a heater is required.

The exhaust type dryer also discharges high temperature and high humid air to the outside and ambient air having room temperature, which is introduced thereto, needs to be heated to a required temperature level through a heater, or the like. In particular, as drying proceeds, humidity of air discharged from the exit of the drum is lowered, and thus, a quantity of heat of air discharged to the outside, rather than being used for drying an item to be dried (or a target dry item) in the drum, is lost, degrading heat efficiency.

Thus, recently, a clothes dryer having a heat pump cycle in which energy discharged from a drum is recovered and used to heat air introduced to the drum, thus enhancing energy efficiency, has been introduced.

Figure 1:
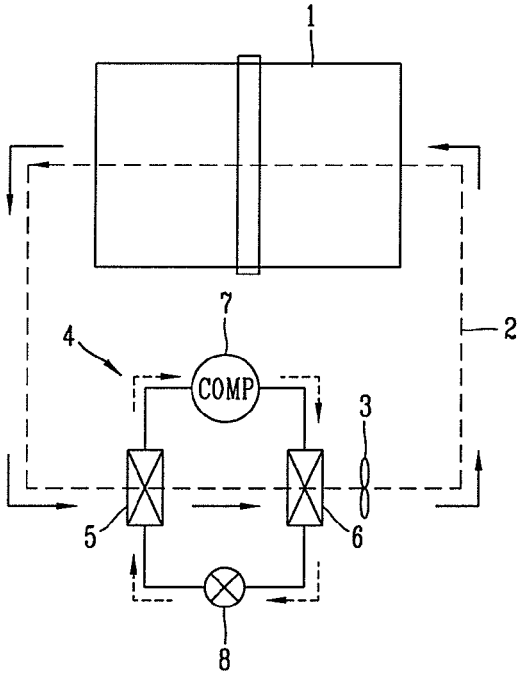
FIG. 1 is a schematic view illustrating an example of a condensing type clothes dryer employing a heat pump cycle.

FIG. 1 is a schematic view illustrating an example of a condensing type clothes dryer employing a heat pump cycle. The condensing type clothes dryer has a heat pump cycle 4 including a drum 1 to which a target dry item is introduced, a circulation duct 2 providing a flow channel allowing air to circulate therein by way of the drum 1, a circulation fan 3 moving circulation air along the circulation duct 2, an evaporator 5 and a condenser 6 installed in series in the circulation duct 2 to allow air circulating along the circulation duct 2 to pass therethrough.

The heat pump cycle 4 may include a circulation pipe forming a circulation channel to allow a refrigerant to circulate therein by way of the evaporator 5 and the condenser 6, and a compressor 7 and an expansion valve 8 installed in the circulation pipe between the evaporator 5 and the condenser 6.

In the heat pump cycle 4 configured as described above, thermal energy of air which has passed through the drum 1 is transmitted to a refrigerant through the evaporator 5, and thermal energy of the refrigerant is transmitted to air introduced to the drum through the condenser 6. Accordingly, heated air may be generated by using thermal energy which is discarded in an existing exhaust type clothes dryer or which is lost in the condensing type clothes dryer. Here, a heater (not shown) for heating air again which is heated while passing through the condenser 6 may be added.

Meanwhile, unlike an air-conditioner or a refrigerator in which an evaporator and a condenser are separately operated in individual flow paths, a refrigerating cycle in the clothes dryer including the heat pump cycle is inevitably broken in heat balance due to an ambient environment formed on a closed circuit, and thus, the refrigerating cycle moves in an upward direction or in a rightward/upward direction in a pressure enthalpy mollier diagram with the passage of time. This is because the sub-components such as an evaporator, a compressor, and a condenser are accommodated in a hermetically closed space within a dryer so a quantity of heat supplied to the interior of the refrigerating cycle from the compressor through compression of a refrigerator by the compressor is relatively great, but an amount of heat discharged to the outside of the refrigerating cycle is relatively small. Also, it is because, the evaporator cannot handle an amount of heat released from the condenser 100% and the compressor cannot sufficiently release heat of the refrigerant generated to have high temperature and high pressure upon being compressed by the compressor, and thus, condensing pressure is increased, repeating a vicious cycle.

In order to solve the problem, an auxiliary condenser (secondary condenser) may be installed in an extending line of the condenser and an independent flow channel is configured outside of a dryer to thereby discharge heat accumulated within the cycle. Accordingly, the cycle is stabilized and dryness of the refrigerant introduced to the entrance of the evaporator is lowered, increasing a difference in absorption of enthalpy, thus enhancing cooling capacity.

However, such method of installing the auxiliary condenser and configuring an independent flow channel incurs additional cost, and since heat released from the condenser is discharged to outside, there is a limitation in directly increasing dehumidifying capability of the evaporator.

Therefore, an aspect of the present disclosure is to provide a clothes treating apparatus having a heat pump capable of directly enhancing dehumidifying capability of an evaporator and stabilizing a refrigerant cycle by installing heat exchangers at a front stage and a rear stage of the evaporator.

According to embodiments of the present disclosure as disclosed hereinafter, dehumidifying capability of the evaporator may be enhanced directly through the heat exchangers respectively disposed at the upper stream side (front stage) and the lower stream side (rear stage) of the evaporator, and an amount of heat that the evaporator of the refrigerant cycle cannot handle sufficiently within the system is actively handled by the heat exchangers, thereby preventing the refrigerant cycle from being increased in the upward or rightward/upward direction in a pressure enthalpy mollier diagram.

Also, since the increase in the refrigerant cycle on the pressure enthalpy mollier diagram does not always hamper enhancement of dry performance of the dryer, the heat exchangers installed at the front and rear stages of the evaporator may be selectively operated in a case in which a condition that evaporation pressure and condensing pressure of a refrigerant cycle or a discharge temperature of the compressor is so high as to cause a problem with reliability of the compressor or a condition that a COP is rapidly reduced is met, thereby contributing to enhancement of performance.

In addition, evaporation pressure and condensing pressure may be maintained at a low level by cooling air at the front stage and the rear stage of the evaporator, stabilizing the refrigerant cycle in terms of reliability. In addition, since an amount of removed moisture is increased, a dry time may be shortened.

Figure 2:
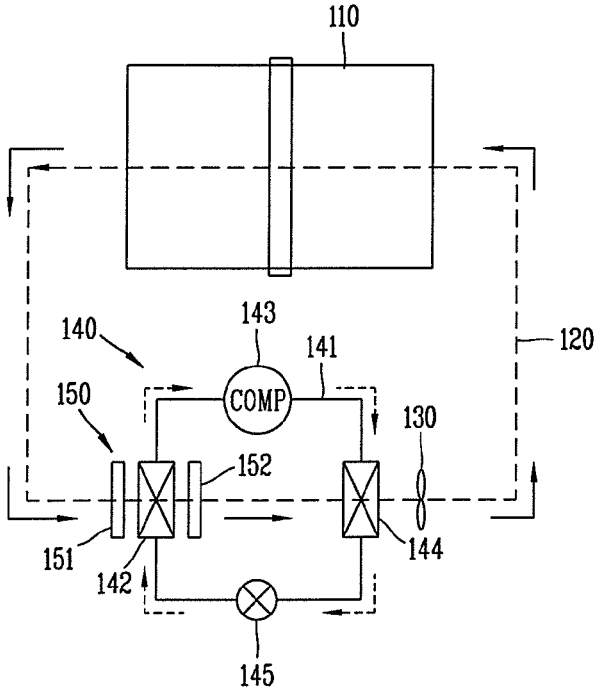
FIG. 2 is a schematic view illustrating a clothes treating apparatus having a heat pump cycle according to one embodiment of the present disclosure.

FIG. 2 is a schematic view illustrating a clothes treating apparatus having a heat pump cycle according to an embodiment of the present disclosure. The clothes treating apparatus may include a case, a drum 110, a circulation duct 120, a heat pump cycle 140, and a dehumidifying system 150. The clothes treating may include a washing dryer having a dry function, a dryer, and the like.

The case forms an outer appearance of the dryer. A circular opening may be formed on a front surface of the case to allow an item to be dried (or a target dry item) to be introduced therein, and a door may be hinge-coupled to one side of the front surface of the case and closes or opens the opening.

The case may include a control panel in an upper end portion of the front side to allow a user to easily manipulate it, and also may include an input unit for inputting various functions of the dryer, and the like, to the control panel and a display unit displaying an operational state, or the like.

The drum 110 may have a cylindrical shape. The drum 110 may be disposed in a laid state in a horizontal direction within the case and rotatably installed therein. The drum 110 may be driven using a rotational force of the driving motor as a power source. A belt (no reference numeral is given) may be wound around an outer circumferential surface of the drum 110, and a portion of the belt may be connected to an output shaft of the driving motor. Accordingly, when the driving motor is actuated, power may be transmitted to the drum 110 through the belt, and accordingly, the drum 110 may be rotated.

A plurality of lifters may be installed within the drum 110, and when the drum 110 is rotated, an item to be dried (or a target dry item) such as wet clothes which has been completely washed is rotated along the drum 110 by the lifters. Here, through an operation (which is called tumbling) in which the target dry item is repeatedly dropped from the peak of a rotational path to the interior of the drum 110 due to gravity, the target dry item is dried within the drum 110, shortening a dry time and dry efficiency.

The condensing type clothes dryer may include a circulation duct 120 forming an air circulation flow channel within the case to allow air to circulate therethrough by way of the drum 110. Also, the condensing type clothes dryer may include a circulation fan 130 provided at one side of the interior of the circulation duct 120 and providing circulation power to enable air to flow along the circulation duct 120. The circulation fan 130 may be driven upon receiving power from the driving motor.

The heat pump cycle 140 absorbs heat of air discharged from the drum 110 to transmit heat to air introduced to the drum 110, thereby serving to heat air introduced to the drum 110. The heat pump cycle 140 may include an evaporator 142, a compressor 143, a condenser 144, and an expansion valve 145. In addition, the heat pump cycle 140 may include a circulation pipe 141 forming a circulation flow channel to allow a refrigerant as a working fluid to circulate therethrough by way of the evaporator 142, the compressor 143, the condenser 144, and the expansion valve 145.

In the heat pump cycle 140, the evaporator 142 absorbs heat of air discharged from the drum 110, and the condenser 144 releases heat to air introduced to the drum 110. In order to absorb heat of humid air released from the drum 110, the evaporator 142 may be installed within the circulation duct 120 and connected to an exit side of the drum 110. In order to release heat to air introduced to the drum, the condenser 144 is installed within the circulation duct and is connected to an entrance side of the drum 110. The evaporator 142 and the condenser 144 may be disposed to be spaced apart from one another within the circulation duct 120, and the condenser 144 may be installed at a lower stream side of the evaporator 142.

The evaporator 142 and the condenser 144 may be a fin-and-tube type heat exchanger. Here, the evaporator 142 may be configured to transmit heat of air which has passed through the drum 110 to a refrigerant as a working fluid, and the condenser 144 may be configured to transmit heat of the refrigerant as a working fluid to air introduced to the drum 110.

Regarding the configuration of the evaporator 142, the evaporator 142 may include a plurality of heat exchange fins in a plate form and a plurality of heat transmission pipes having a refrigerant flow channel. The heat exchange fins may be spaced apart from one another in a direction perpendicular to an air movement direction and vertically disposed, and when air passes through the evaporator 142, air may pass through an air flow path formed between the heat exchange fins. The heat transmission pipes each may have a refrigerant flow channel formed to allow a refrigerant to flow therein.

Also, the heat transmission pipes may be coupled through the heat exchange fins, and each of the heat transmission pipes may be disposed to be spaced apart from one another in a vertical direction. The heat transmission pipes disposed to be spaced apart from one another may be connected to each other by a connection pipe formed to be curved to have a semicircular shape. The heat transmission pipes connected in this manner may expand a contact area with air through the plurality of heat exchange fins, and a refrigerant as a working fluid flowing within the heat transmission pipes and air which passes through the air flow path between the heat exchange fins may undergo heat exchange.

When passing through the evaporator 142 and the heat exchangers disposed at the upper stream side of the evaporator and the lower stream side of the evaporator, air is introduced to an entrance of the air flow path of each of the evaporators 142, moves along the refrigerant flow channel, and flows out through an exit of the refrigerant flow channel. The air flow path between the heat exchange fins may be separated from the refrigerant flow channel by the heat transmission pipe, and thus, the air and the refrigerant may undergo heat exchange with each other, without being mixed with each other. The condenser 144 may have the same configuration as that of the evaporator 142, and thus, a detailed description thereof will be omitted.

A heat transmission operation from a vantage point of the air circulation path and air in the clothes treating apparatus having the heat pump cycle 140, will be described. When the circulation fan 130 is actuated, dried air having a high temperature which has been heated by the condenser 144 is introduced to the entrance of the drum 110, and comes into contact with a target dry item accommodated in the drum 110 to dry the target dry item. Air, which has dried the target dry item, and thus, is in a humid condition, is discharged from the drum 110. The discharged humid air is moved along the circulation duct 120 and undergoes heat exchange with the refrigerant at the evaporator 142 so as to be cooled and dehumidified. Thereafter, the dehumidified air may undergo heat exchange with the refrigerant at the condenser 144 so as to be heated, and the heated air is introduced to the entrance of the drum 110 so as to circulate.

Meanwhile, a heat transmission operation from a vantage point of the circulation path of the refrigerant as a working fluid and the refrigerant will be described. When the compressor 143 is actuated, the compressor 143 compresses a gas phase refrigerant having a low temperature and low pressure to produce a refrigerant having high temperature and high pressure to generate circulation power for circulating the refrigerant. The refrigerant circulates to pass from the compressor 143 to the condenser 144, the expansion valve 145, and the evaporator 143, and to the compressor 143 again by the circulation power.

The refrigerant having a high temperature and high pressure generated by the compressor 143 releases heat in the condenser 144 to transmit air introduced to the drum 110, and the refrigerant itself is changed from the gaseous phase refrigerant having a high temperature and high pressure into a liquid phase refrigerant having a high temperature and high pressure by the released condensing latent heat. The liquid phase refrigerant condensed by the condenser 144 is dropped in pressure by the expansion valve 145 and rapidly lowered in temperature. The refrigerant which has passed through the expansion valve 145, in a state in which the gas phase refrigerant having low pressure and the liquid phase refrigerant are mixed, is introduced to the entrance of the evaporator 142. The refrigerant introduced to the evaporator 142 absorbs heat of air discharged from the drum 110 so as to be evaporated, and the evaporated gas phase refrigerant having a low temperature and low pressure is introduced again to the compressor 143.

Here, the present disclosure provides a dehumidification system 150 for cooling and dehumidifying air passing through the evaporator 142. Accordingly, dehumidifying capability of the refrigerant cycle may be enhanced and the cycle may be stabilized.

The dehumidification system 150 may include a plurality of heat exchangers installed in an upper stream and a lower stream of the evaporator 142 with respect to an air movement direction. The heat exchangers may be water cooling type heat exchangers or air cooling type heat exchangers.

Figure 3:
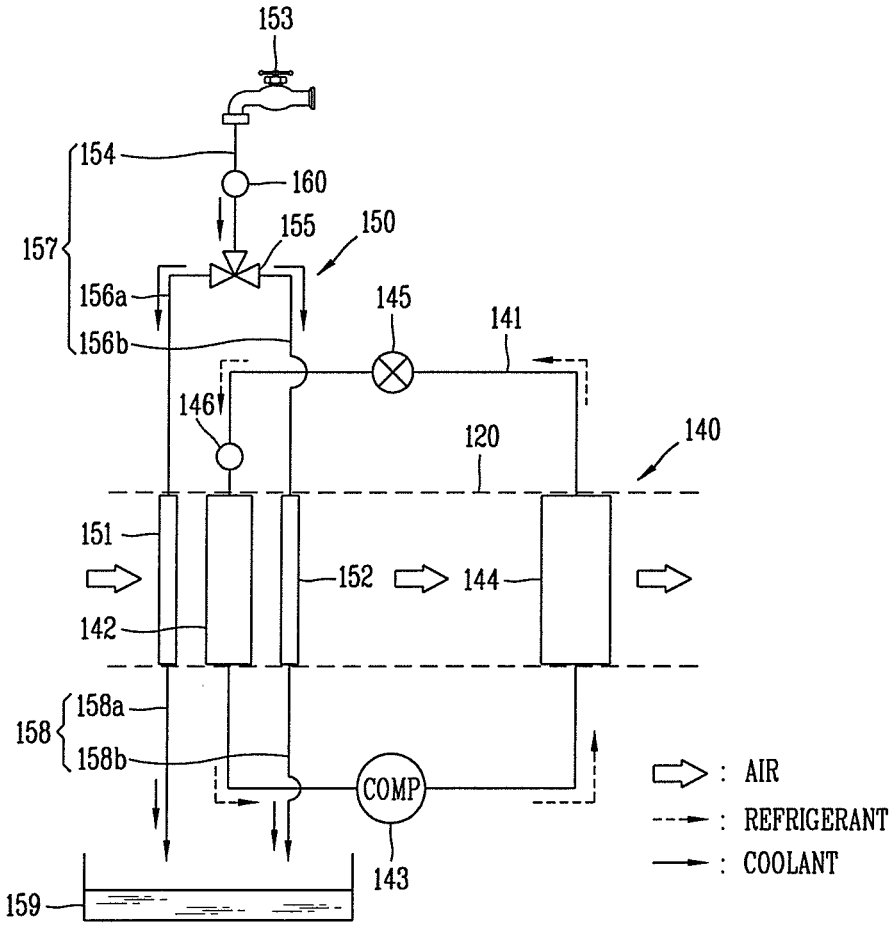
FIG. 3 is a schematic view illustrating a dehumidification system according to one embodiment of the present disclosure.

FIG. 3 is a schematic view illustrating a dehumidification system having one exemplary configuration. The dehumidification system may include various components and may be referred to herein as a dehumidification device. The heat exchanger in this example may be a water cooling type heat exchanger. The water cooling type heat exchanger may be a fin-and-tube type heat exchanger.

A plurality of heat exchangers as illustrated in FIG. 3 may include a first water cooling type heat exchanger 151 disposed at an upper stream side of the evaporator 142 and a second water cooling type heat exchanger 152 disposed at a lower stream side of the evaporator 142.

The dehumidification system 150 may include a water supply unit 153 for supplying water to the first and second water cooling type heat exchanger 152, a water feed pipe 157 forming a water feed flow channel forming a water feed flow path to allow water to be supplied to each of the heat exchangers, and a drain pipe 158 forming a water drain flow path to allow water to be discharged from each of the heat exchangers. The water supply unit 153 may use a tap water line in a dryer or a washing dryer.

The water feed pipe 157 may include a main water feed pipe 154 connected to a faucet and a plurality of branch pipes 156*a* and 156*b* forming a branch flow channel to allow water branched from the main water feed pipe 154 to be introduced to each of the heat exchangers therethrough.

The plurality of branch pipes 156*a* and 156*b* may include a first branch pipe 156*a* connecting the main water feed pipe 154 and the first water cooling type heat exchanger 151 and a second branch pipe 156*b* connecting the main water feed pipe 154 and the second cooling type heat exchanger 152. An end portion of each of the branch pipes 156*a* and 156*b* may be connected to a distributor formed to be branched from the main water feed pipe 154, and the other end portion of each of the branch pipes 156*a* and 156*b* may be connected to an entrance of a coolant flow channel of each of the heat exchangers.

As illustrated in FIG. 3, the drain pipe 158 may be installed at an exit of the coolant flow channel of each of the heat exchangers. For example, the drain pipe 158 may be divided into a first water drain pipe 158*a* connected to the first water cooling type heat exchanger 151 and a second drain pipe 158*b* connected the second water cooling type heat exchanger 152. In this case, a coolant discharged from each of the heat exchangers may be independently discharged.

A three way valve 155 may be installed in the distributor where the branch pipes 156*a* and 156*b* meet, to adjust a flow rate of water supplied to each of the heat exchangers by the three way valve 155. Also, water may be selectively supplied to the first water cooling type heat exchanger 151 and the second water cooling type heat exchanger 152 according to a feed water temperature.

In case of tap water that may be used as a coolant, since tap water has a significant difference in temperature according to seasons, and thus, a first temperature sensor 160 may be installed in a raw water line to which a coolant is supplied in order to recognize a temperature of the coolant.

For example, the first temperature sensor 160 may be installed in the main water feed pipe 154 to measure a feed water temperature. Also, a second temperature sensor 146 may be installed at the entrance of the evaporator 142 in order to sense an evaporation temperature of a refrigerant.

The clothes treating apparatus of the present disclosure may include a controller 170 for selectively supplying a coolant to any one of the first and second water cooling type heat exchangers 151 and 152 according to a feed water temperature by comparing the feed temperature and an evaporation temperature. To this end, the coolant may be selectively supplied to the first and second water cooling type heat exchangers 152 by controlling the three way valve 155. Thus, a position for supplying a coolant according to a temperature difference according to seasons may be effectively determined.

For example, in a case in which the feed water temperature is lower than the evaporation temperature, it may be effective to supply the coolant to the second water cooling type heat exchanger 152 positioned at a rear stage of the evaporator 154. Humid air released from the drum 110 is introduced to the evaporator 142, dehumidified through first cooling in the evaporator 142, and subsequently secondarily cooled by a coolant of the second water cooling type heat exchanger 152 having a temperature lower than an evaporation temperature of the evaporator 142 while passing through the second water cooling type heat exchanger 152. Thus, an amount of dehumidified moisture (that is, an amount of moisture removed in the air) is increased. Here, since the coolant is not supplied to the first water cooling type heat exchanger 151, when air passes through the first water cooling type heat exchanger 151, before being introduced to the evaporator 142, the air is not cooled nor dehumidified.

In a case in which the feed water temperature is higher than the evaporation temperature, the coolant is supplied to the first water cooling type heat exchanger 151 positioned at a front stage of the evaporator 142. Humid air released from the drum 110 may be first cooled in the first water cooling type heat exchanger 151, introduced again to the evaporator 142, and secondarily cooled again.

A water reservoir 159 may be installed below the heat exchangers. Water discharged through the drain pipe 158, after being used in the first and second water cooling type heat exchangers 152, may be stored in the water reservoir 159 for additional reuse or may be drained if not used again. The water reservoir 159 may have a tank form (for example, a water tank), and when the water reservoir 159 has a tank form, the drain pipe 158 may be connected to a tank inlet. For example, water discharged from the water cooling type heat exchanger is in a state of having been heated by heat of air discharged from the drum 110, so the water may be recycled as washing water.

Figure 4:
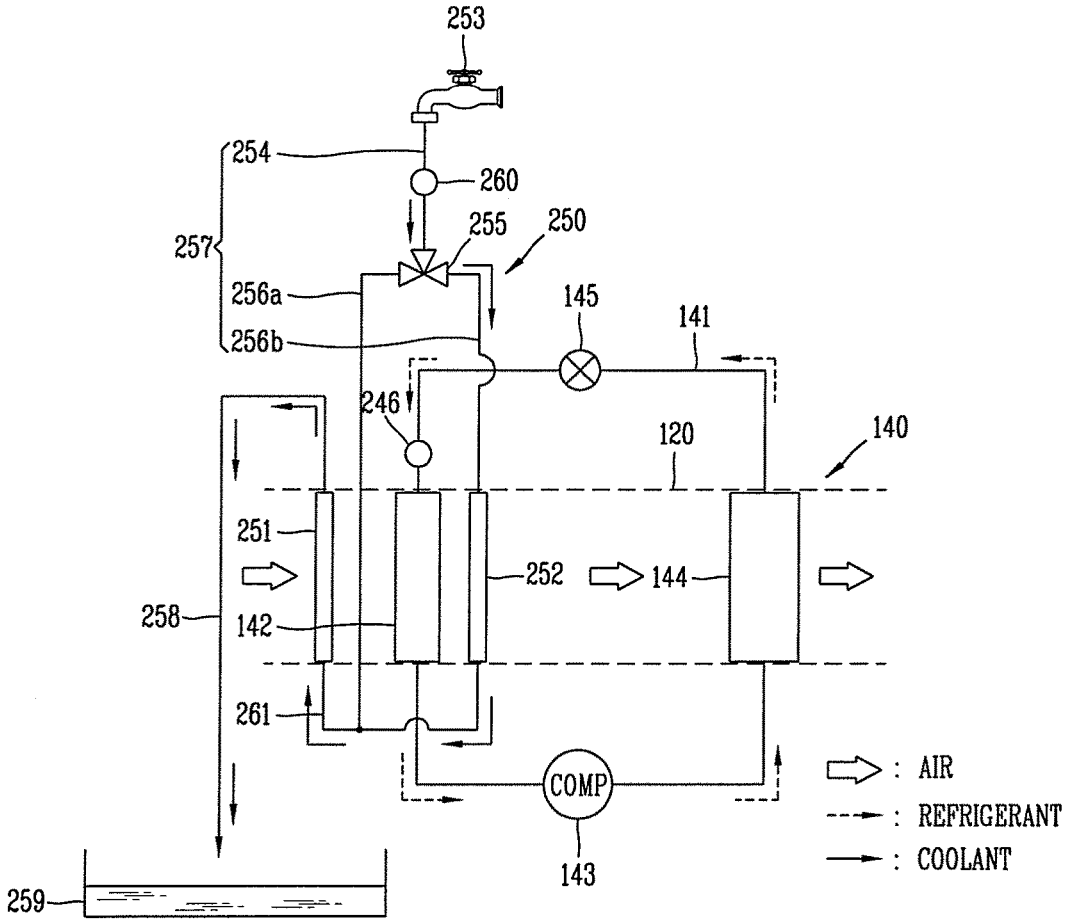
FIG. 4 is a schematic view illustrating a dehumidification system according to another embodiment of the present disclosure.

FIG. 4 is a schematic view illustrating a dehumidification system having another exemplary configuration. In this example, a first water cooling type heat exchanger 251 and the second water cooling type heat exchanger 252 may be connected by a first connection pipe 261. Unlike the first branch pipe 156*a* illustrated in FIG. 3, the other end portion of a first branch pipe 256*a* branched from a main water feed pipe 254 is connected to a lower stream side (with respect to a coolant movement direction) of the first connection pipe 261. A single drain pipe 258 is provided and connected to the first water cooling type heat exchanger 251. Other components are the same as or similar to those of the first embodiment, and thus, a detailed description thereof will be omitted for the clarity of the description.

A movement path of a coolant according to a feed water temperature in this configuration is now described. In a case in which a feed water temperature is lower than an evaporation temperature, a branch flow channel of the second water cooling type heat exchanger 252 positioned in a rear stage of the evaporator 142 is opened by a three way valve 255, and a coolant introduced to the second water cooling type heat exchanger 252 removes sensible heat and latent heat of air which has passed through the evaporator 142 to remove moisture contained in the air. Here, a temperature of the coolant which has removed heat of the air in the second water cooling type heat exchanger 252 is slightly increased. Thereafter, the coolant released from the second water cooling type heat exchanger 252 is moved to the first water cooling type heat exchanger 251 positioned in a front stage of the evaporator 142 through the first connection pipe 261 and used to remove sensible heat and latent heat of air to be introduced to the evaporator 142 dually. The coolant discharged from the first water cooling type heat exchanger 251 may be re-heated by the first water cooling type heat exchanger 251 and subsequently stored in a separate water reservoir 259 or drained.

In a case in which the feed water temperature is higher than the evaporation temperature, a branch flow channel at the first water cooling type heat exchanger 251 side positioned at the front stage of the evaporator 142 is opened by the three way valve 255, the coolant is supplied from the first branch pipe 256*a* to the first water cooling type heat exchanger 251 through the first connection pipe 261 and removes sensible heat and latent heat of air to be introduced to the evaporator 142 in the first water cooling type heat exchanger 251 so as to be used to remove moisture in the air, and subsequently stored in the separate water reservoir 259 or drained.

Figure 5:
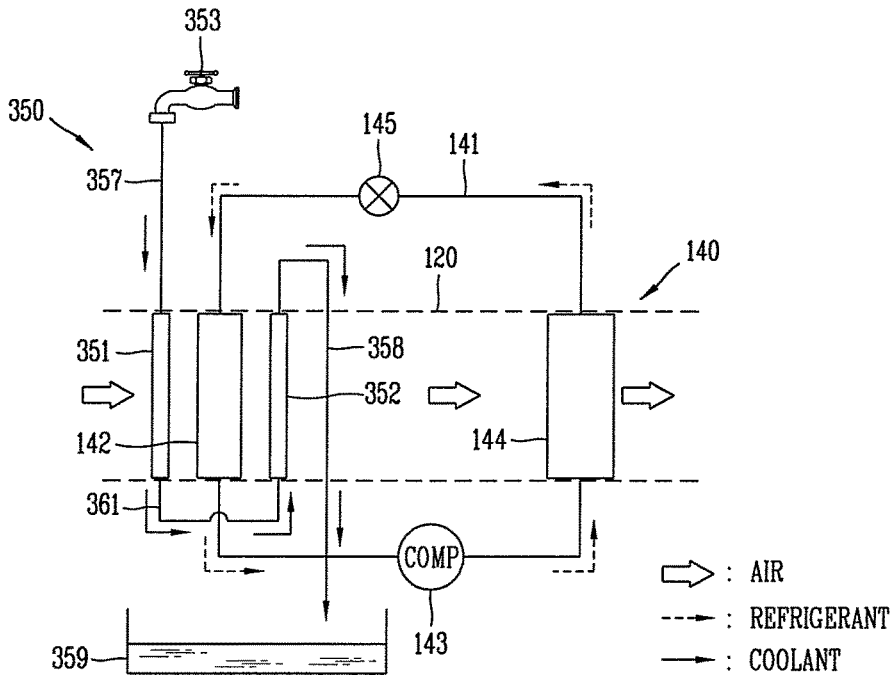
FIG. 5 is a schematic view illustrating a dehumidification system according to another embodiment of the present disclosure.

FIG. 5 is a schematic view illustrating a dehumidification system having another exemplary configuration. In this example, a first water cooling type heat exchanger 351 and a second water cooling type heat exchanger 352 illustrated in FIG. 5 are connected by a second connection pipe 361. A water feed pipe 357 is directly connected to a first water cooling type heat exchanger 351, rather than being configured as the main water feed pipe 154 and the branch pipes 156*a* and 156*b* illustrated in FIG. 3. Also, a drain pipe may be connected only to the second water cooling type heat exchanger 352. In this case, a first temperature sensor may be omitted.

A coolant movement path and an operation of a coolant according to the third embodiment will be described. A coolant is introduced to the first water cooling type heat exchanger 351 through the water feed pipe 357, and the first water cooling type heat exchanger 351 cools sensible heat and latent heat of air to be introduced to the evaporator 142 by using the coolant to remove moisture in the air. Here, the coolant of the first water cooling type heat exchanger 351 receives heat from the humid air discharged from the drum.

The coolant released from the first water cooling type heat exchanger 351 is introduced to the second water cooling type heat exchanger 352 through the second connection pipe 261. The coolant introduced to an entrance of a coolant flow channel of the second water cooling type heat exchanger 352 meets air which has passed through the evaporator 142 at the second water cooling type heat exchanger 352 so as to be used to heat air. Thus, the second water cooling type heat exchanger 352 according to the present embodiment may collect partial sensible heat of air introduced to the evaporator 142 so as to be used to heat air which has passed through the evaporator 142. Also, in this case, the clean water heated as necessary may be stored in a separate water reservoir for a specific purpose or may be drained.

Thus, according to the first embodiment to the third embodiment described above, since the water cooling type heat exchangers are disposed at the front state and at the rear state of the evaporator 142 to cool air which passes through the evaporator 142, dehumidification capability may be directly enhanced, and a quantity of heat of air which the evaporator 142 of the refrigerant cycle cannot handle is actively handled within the system, whereby an effect of preventing the refrigerant cycle from being increased in the upward direction or in rightward/upward direction in a pressure enthalpy mollier diagram can be obtained.

Figure 6:
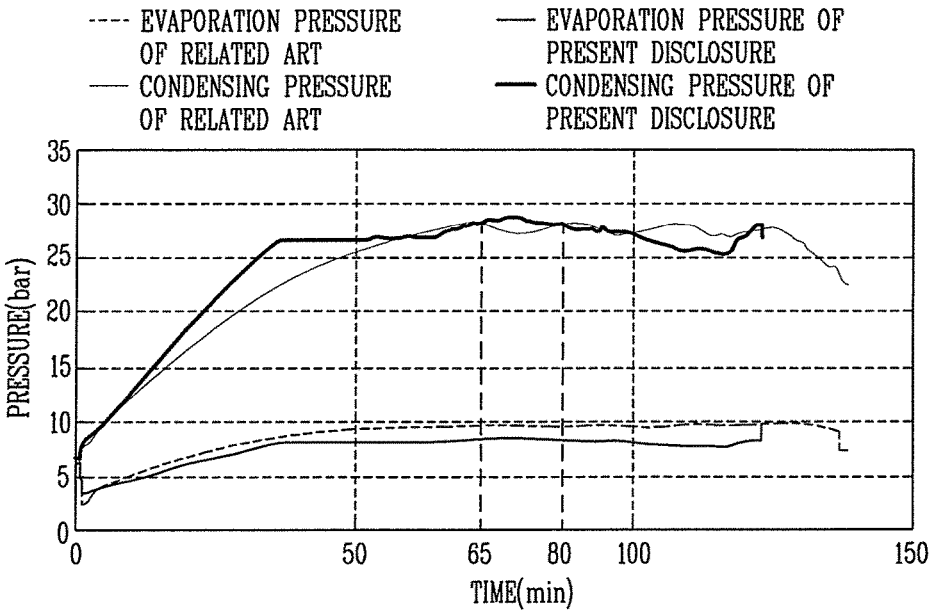
FIG. 6 is a graph illustrating a change in pressure in a heat pump cycle employing a water cooling heat exchanger (precool) and without a water cooling heat exchanger.
Figure 7:
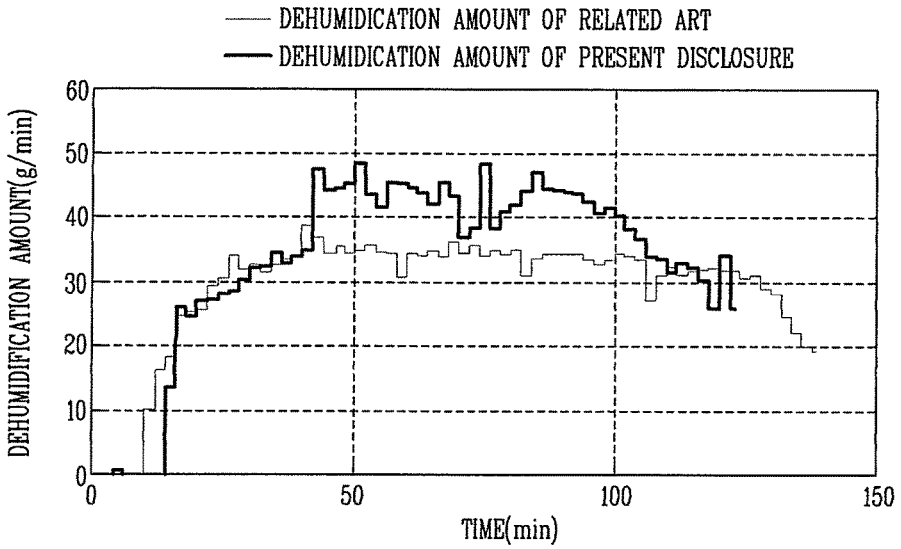
FIG. 7 is a graph illustrating an amount of removed moisture in a dehumidification system employing a water cooling heat exchanger (precool) and without a water cooling heat exchanger.

FIG. 6 is a graph illustrating a change in pressure according to the embodiment (present disclosure) employing a water cooling heat exchanger (precool) and comparative example (related art) without a water cooling heat exchanger, and FIG. 7 is a graph illustrating an amount of removed moisture according to the embodiment (present disclosure) employing a water cooling heat exchanger (precool) and comparative example (related art) without a water cooling heat exchanger.

Referring to FIG. 6, it can be seen that evaporation pressure (indicated by the thick line) of the embodiment to which the water cooling type heat exchanger was applied is lower than evaporation pressure (indicated by the thin line) of comparative example without using a water cooling type heat exchanger. Also, condensing pressure compared with reliability limit was maintained at a lower level, enabling a continuous operation without turning off the heat pump cycle, which leads to shortening of a dry time of about 20 minutes. However, when the amount of the coolant was arbitrarily controlled to be reduced to about a half, condensing pressure of the present disclosure was increased when it was 65 minutes to 80 minutes in the graph of FIG. 6. In this manner, when the flow rate of the coolant equal to or greater than an appropriate amount is maintained, evaporation pressure and condensing pressure may be managed at a low level, thereby stabilizing the refrigerant cycle in terms of reliability.

Referring to FIG. 7, an amount of removed moisture (indicated by the thick line) of the embodiment to which the water cooling type heat exchanger was applied is greater than an amount of removed moisture of comparative example without using the water cooling type heat exchanger, and thus, a dry time is also further shortened.

However, since the increase in the refrigerant cycle does not always interrupt enhancement of dry performance, the first and second water cooling type heat exchanges 351 and 352 of the present disclosure may be selectively operated only when conditions, such as a situation in which evaporation pressure or condensing pressure or a discharge temperature of the compressor is so high that reliability of the compressor is problematic or a situation in which a coefficient of performance (COP) is rapidly reduced, are met, to contribute to enhancement of the performance of the dryer.

Figure 8:
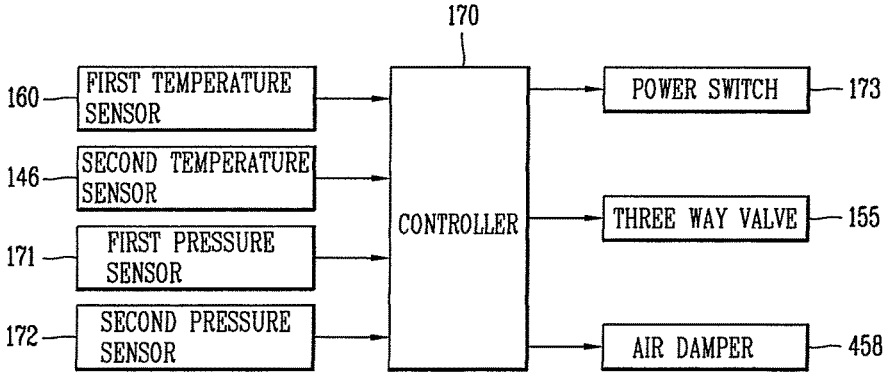
FIG. 8 is a block diagram illustrating a control device for controlling a clothes treating apparatus according to an embodiment of the present disclosure.

FIG. 8 is a block diagram illustrating a control device for controlling a clothes treating apparatus according to an embodiment of the present disclosure. To this end, the heat pump cycle according to an embodiment of the present disclosure includes a first pressure sensor 171 installed in the evaporator 142 to sense evaporation pressure, and a second pressure sensor 172 installed in the condenser to sense condensing pressure.

The controller 170 may control operations of the first and second cooling type heat exchangers 351 and 352 according to the sensed pressure by comparing at least one of the evaporation pressure and the condensing pressure with reference pressure.

For example, when the evaporation pressure or the condensing pressure is greater than the reference pressure, operations of the first and second cooling type heat exchangers 351 and 352 may be stopped. A power switch 173 of the first and second cooling type heat exchangers 351 and 352 may be switched off. Also, in a case in which the evaporation pressure or the condensing pressure is equal to or lower than the reference pressure, the first and second cooling type heat exchangers 351 and 352 may be selectively operated. In this case, the power switch 173 of the first and second cooling type heat exchangers 351 and 352 may be selectively switched on.

Figure 9:
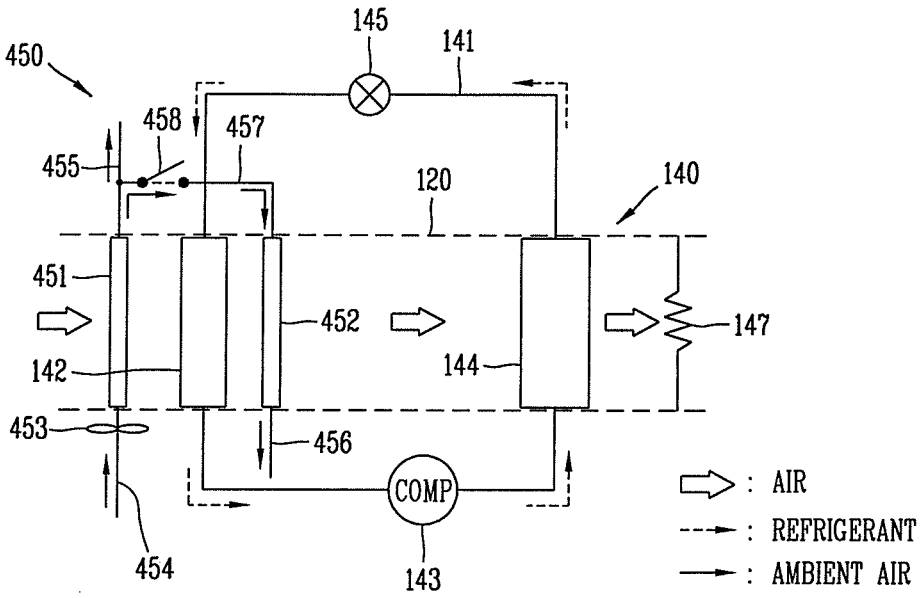
FIG. 9 is a schematic view illustrating a dehumidification system 450 according to another embodiment of the present disclosure.

FIG. 9 is a schematic view illustrating a dehumidification system having another exemplary configuration. In this example, the dehumidification system 450 may be configured as an air cooling type dehumidification system 450, unlike the water cooling type described above. A first air cooling type heat exchanger 451 may be installed at an upper stream side of the evaporator 142 with respect to an air movement direction within the circulation duct 120, and a second air cooling type heat exchanger 452 may be installed at a lower stream side of the evaporator 142.

In the dehumidification system 450, an air blow fan 453 is provided to supply ambient air (cooling fluid or cold air outside of the dryer) to the first air cooling type heat exchanger 451. The air blow fan 453 may be installed in an intake pipe 454 connected to an entrance of a cooling flow channel of the first air cooling type heat exchanger 451 to form an intake flow channel. The air blow fan 453 may be driven by a motor.

The first air cooling type heat exchanger 451 and the second air cooling type heat exchanger 452 may be connected by a connection duct 457, whereby ambient air discharged from the first air cooling type heat exchanger 451 may be introduced to the second air cooling type heat exchanger 452 so as to be recycled. One end portion of the connection duct 457 may be connected to an exit of the cooling flow channel of the first air cooling type heat exchanger 451, and the other end portion of the connection duct 457 may be connected to the entrance of the cooling flow channel of the second air cooling type heat exchanger 452. Here, the exit of the cooling flow channel of the first air cooling type heat exchanger 451 and the entrance of the cooling flow channel of the second air cooling type heat exchanger 452 may be formed in the same direction, and the connection duct 457 is formed to have a U shape, for example, whereby a cooling fluid released from the first air cooling type heat exchanger 451 may hang a U (turn) so as to be introduced to the second air cooling type heat exchanger 452.

An exhaust pipe forming an exhaust flow channel is connected to each of the exists of the cooling flow channels of the first air cooling type heat exchanger 451 and the second air cooling type heat exchanger 452. A first exhaust pipe 455 is connected to the first air cooling type heat exchanger 451, and a second exhaust pipe 456 is connected to the second air cooling type heat exchanger 452.

The connection duct 457 may be formed to be branched from the first exhaust pipe 455 or may be formed separately from the first exhaust pipe 455. The connection duct 457 illustrated in FIG. 9 is formed to be branched from the first exhaust pipe 455.

An air damper 458 may be installed in at least one of point at which the connection duct 457 is branched from the first exhaust pipe 455 or the connection pipe. The air damper 458 may be configured to adjust a degree of opening of the connection duct 457. For example, the air damper 458 may be controlled by a control signal from the controller 170.

A first pressure sensor 172 may be installed at the entrance of the evaporator 142, and a second pressure sensor 172 may be installed in the condenser. The controller 170 may adjust a degree of opening the connection duct 457 by controlling the air damper 458 according to measured pressure from the first pressure sensor 171 and the second pressure sensor 172, by comparing evaporation pressure of the evaporator 142 and condensing pressure of the condenser with reference pressure.

In a case in which at least one of the evaporation pressure and the condensing pressure is greater than the reference pressure, the cooling fluid discharged from the first air cooling type heat exchanger 451 may be discharged to the outside. Also, in a case in which at least one of the evaporation pressure and the condensing pressure is equal to or lower than the reference pressure, the cooling fluid discharged from the first air cooling type heat exchanger 451 may be transmitted to the second air cooling type heat exchanger 452, whereby the cooling fluid may be recycled to heat air which has passed through the evaporator 142 in the second air cooling type heat exchanger 452.

Also, a heater 147 may be additionally installed within the circulation duct 120 to heat air introduced to the drum. The heater 147 may be used to rapidly heat air introduced to the drum at an initial stage of drying or may be used when an amount of heat released through the condenser is insufficient.

A movement path of a cooling fluid of the dehumidification system 450 configured described above and an operation thereof is now described. A cooling fluid that flows through the air blow fan 453 is introduced to a cooling flow channel of the first air cooling type heat exchanger 451 through the intake pipe 454. The cooling fluid introduced to the cooling flow channel is heat-exchanged with air which passes through the first air cooling type heat exchanger 451 to remove sensible heat and latent heat of air. Accordingly, enthalpy of air introduced to the evaporator 142 may be lowered to reduce a burden to the evaporator 142 and increase cooling capacity, thus enhancing dehumidifying performance. Here, since the cooling fluid itself absorbs heat from air, a temperature thereof is slightly increased.

However, if the cooling fluid flowing along the cooling flow channel of the first air cooling type heat exchanger 451 is used to cool air introduced to the evaporator 142 and subsequently exhausted to the outside through the first exhaust pipe 455, it may result in discarding of effective energy of the refrigerant cycle to the outside.

In order to complement this, in the present disclosure, the second air cooling type heat exchanger 452 positioned at the rear stage of the evaporator 142 may be used as the air heater 147. That is, as the second air cooling type heat exchanger 452 receives the cooling fluid discharged from the first air cooling type heat exchanger 451, the second air cooling type heat exchanger 452 may collect a portion of sensible heat of air discharged from the drum and re-use it to heat air which has passed through the evaporator 142.

For example, air discharged from the drum may be cooled by way of the evaporator 142 through the first air cooling type heat exchanger 451, while moving along the circulation duct 120. As the cooled air passes through the second air cooling type heat exchanger 452, enthalpy may be somewhat recovered. Accordingly, waste due to discharge of internal energy through the first air cooling type heat exchanger 451 (air cooler) mentioned above may be minimized.

However, in a case in which recycling of heat is not necessary because pressure of the refrigerant cycle is generally high, the cooling fluid which has passed through the first air cooling type heat exchanger 451 may be exhausted immediately to the outside by using the air damper 458 between the first water cooling type heat exchanger 451 and the second water cooling type heat exchanger 452.

Figure 10:
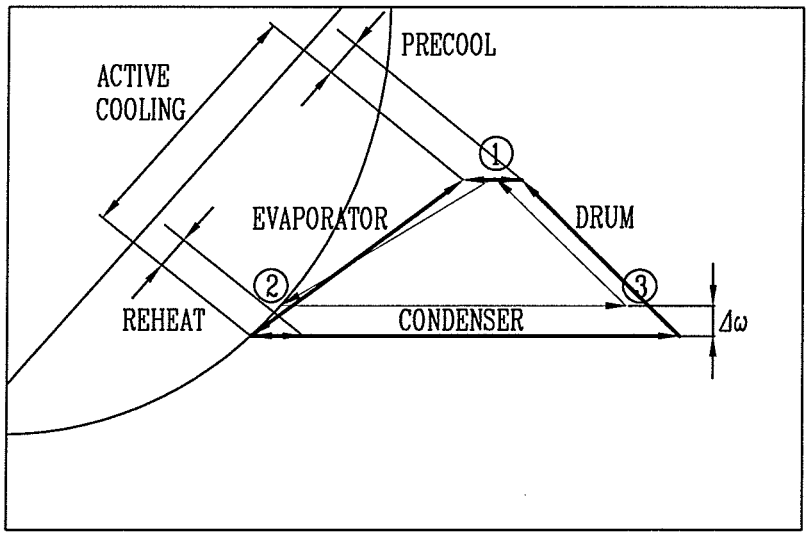
FIG. 10 is a schematic view illustrating a change in pressure enthalpy mollier diagram of humid air according to a configuration of a water cooling type heat exchanger.

FIG. 10 is a schematic view illustrating a change in pressure enthalpy mollier diagram of humid air according to a configuration of a water cooling type heat exchanger. FIG. 10 illustrates an energy recovery process of precooling and reheating according to an embodiment of the present disclosure. Precooling refers to cooling air which passes through the evaporator 142 in advance by the first water cooling type heat exchanger or the second water cooling heat exchanger. Reheating refers to heating air which has passed through the evaporator 142 by introducing a cooling fluid discharged from the first heat exchanger (including the water cooling type heat exchanger and the air cooling type heat exchanger) installed at a front stage of the evaporator 142 and reusing the introduced cooling fluid.

Referring to FIG. 10, the thick lines represent a change in psychometric chart in the clothes dryer having a heat pump cycle according to an embodiment of the present disclosure, and the thin lines represent a change in psychometric chart in the clothes treating apparatus having a heat pump cycle according to the related art (without precooling and reheating).

(1) indicates an exit of the drum, (2) indicates an exit of the evaporator 142, and (3) indicates an exit of the condenser.

As a result, cooling capacity represented by the sum of precooling and active cooling according to an embodiment of the present disclosure indicated by the thick lines is increased compared with cooling capacity in the process of (1) and (2) of the related art, that is, in the evaporation process by the evaporator 142 indicated by the thin lines, an amount of removed moisture may be increased by Δω and a dry time may be shortened.

In addition, since a portion of an amount of heat of precooling is recovered through reheating according to an embodiment of the present disclosure, a temperature of dry air supplied from the exit of the condenser to the drum may be increased, which may contribute to evaporation of water from the wet clothes accommodated within the drum and acceleration of drying. Also, shortcomings in the case in which only precooling is performed by the first air cooling type heat exchanger 451 may be complemented.

As broadly described and embodied herein, a clothes treating apparatus may include a heat pump and a dehumidifying device. An aspect of the present disclosure is to provide a clothes treating apparatus having a heat pump capable of directly enhancing dehumidifying capability of an evaporator and stabilizing a refrigerant cycle by installing heat exchangers at a front stage and a rear stage of the evaporator.

To achieve these and other advantages and in accordance with the purpose of this specification, as embodied and broadly described herein, a clothes treating apparatus may include: a case; a drum installed within the case and configured to accommodate a target dry item; a circulation duct configured to form an air circulation flow channel allowing air to circulate therein by way of the drum; a heat pump cycle configured to have an evaporator and a condenser disposed to be spaced apart from one another within the circulation duct, and absorb heat of air released from the drum through the evaporator and transmit the absorbed heat to air introduced to the drum through the condenser, by using a working fluid circulating by way of the evaporator and the condenser; and a dehumidification system configured to dehumidify air passing through the evaporator.

According to an example in relation to the present disclosure, the dehumidification system may include: a first water cooling type heat exchanger and a second water cooling type heat exchanger installed within the circulation duct and respectively disposed at an upper stream side and a lower stream side of the evaporator with respect to an air movement direction; a water supply unit configured to supply water to the first water cooling type heat exchanger and the second water cooling type heat exchanger; a water feed pipe configured to form a water feed flow channel to allow water to be supplied to the first water cooling type heat exchanger and the second water cooling type heat exchanger; and a drain pipe configured to form a drain flow channel to allow water to be discharged from the first water cooling type heat exchanger and the second water cooling type heat exchanger.

According to an example in relation to the present disclosure, the dehumidification system may include: a water reservoir configured to store water drained from the Darwin pipe.

According to an example in relation to the present disclosure, the dehumidification system may include: a first temperature sensor installed at the water feed pipe and configured to measure a water feed temperature; a second temperature sensor installed at the evaporator and configured to measure an evaporation temperature; a three way valve installed at the water feed pipe; and a controller configured to control the three way valve.

According to an example in relation to the present disclosure, the controller may compare the water feed temperature and the evaporation temperature, and control the three way valve according to the water feed temperature to selectively supply water to the first water cooling type heat exchanger and the second water cooling type heat exchanger.

According to an example in relation to the present disclosure, the drain pipe may include a first drain pipe connected to the first water cooling type heat exchanger and a second drain pipe connected to the second water cooling type heat exchanger, and water from each of the first water cooling type heat exchanger and the second water cooling type heat exchanger may be independently drained.

According to an example in relation to the present disclosure, the dehumidification system may include a first connection pipe connecting the first water cooling type heat exchanger and the second water cooling type heat exchanger to allow a coolant discharged from the second water cooling type heat exchanger to be introduced to the first water cooling type heat exchanger so as to be re-used.

According to an example in relation to the present disclosure, the water feed pipe may include: a main water feed pipe connected to the water supply unit; and a plurality of branch pipes branched from the main water feed pipe and configured to form branch flow channels allowing the water to be supplied to the first water cooling type heat exchanger and the second water cooling type heat exchanger, respectively, wherein a first branch pipe connected to the first water cooling type heat exchanger, among the plurality of branch pipes, may be connected to the first connection pipe and the water may be supplied to the first water cooling type heat exchanger by way of the first connection pipe.

According to an example in relation to the present disclosure, the water feed pipe may be connected to the first water cooling type heat exchanger, the first water cooling type heat exchanger and the second water cooling type heat exchanger may be connected by the second connection pipe to allow water discharged from the first water cooling type heat exchanger to be introduced to the second water cooling type heat exchanger so as to be re-used, and the drain pipe may be connected to the second water cooling type heat exchanger.

According to an example in relation to the present disclosure, the heat pump cycle may include: a first pressure sensor installed at the evaporator and configured to sense evaporation pressure; and a second pressure sensor installed at the condenser and configured to sense condensing pressure, wherein the controller may compare at least one of the evaporation pressure and the condensing pressure with reference pressure, and control operations of the first water cooling type heat exchanger and the second water cooling type heat exchanger according to the sensed pressure.

According to an example in relation to the present disclosure, the dehumidification system may include: a first air cooling type heat exchanger and a second air cooling type heat exchanger installed within the circulation duct and respectively disposed at the upper stream side and the lower stream side of the evaporator with respect to the air movement direction; an intake pipe configured to form an intake flow channel to allow air outside the case to be introduced to the first air cooling type heat exchanger therethrough; an air blow fan installed at the intake pipe and configured to intake the air and blow the intaken air to the first air cooling type heat exchanger; a plurality of exhaust pipes respectively installed at the first air cooling type heat exchanger and the second air cooling type heat exchanger and configured to form an exhaust flow channel to allow air from the first air cooling type heat exchanger and the second air cooling type heat exchanger to be exhausted to outside; and a connection duct configured to connect the first air cooling type heat exchanger and the second air cooling type heat exchanger to allow air discharged from the first air cooling type heat exchanger to be introduced to the second air cooling type heat exchanger so as to be re-used.

According to an example in relation to the present disclosure, the heat pump cycle may include a first pressure sensor installed at the evaporator and configured to sense evaporation pressure; and a second pressure sensor installed at the condenser and configured to sense condensing pressure, wherein the dehumidification system may include a controller configured to compare at least one of the evaporation pressure and the condensing pressure with reference pressure and control operations of the first air cooling type heat exchanger and the second air cooling type heat exchanger according to the sensed pressure.

According to an example in relation to the present disclosure, the controller may control a flow rate of air introduced to the second air cooling type heat exchanger by exhausting air from the first air cooling type heat exchanger or adjust a degree of opening of the connection duct according to the sensed pressure.

According to an example in relation to the present disclosure, the dehumidification system may further include: an air damper rotatably installed at the connection duct to open and close the connection duct.

According to an example in relation to the present disclosure, the connection duct may be formed to be branched from a first exhaust pipe connected to the first air cooling type heat exchanger, among the plurality of exhaust pipes.

To achieve these and other advantages and in accordance with the purpose of this specification, as embodied and broadly described herein, a method for controlling clothes treating apparatus including: a drum configured to accommodate a target dry item; a circulation duct configured to form an air circulation flow channel allowing air to circulate therein by way of the drum; a heat pump cycle configured to have an evaporator and a condenser disposed to be spaced apart from one another within the circulation duct, and absorb heat of air released from the drum through the evaporator and transmit the absorbed heat to air introduced to the drum through the condenser, by using a working fluid circulating by way of the evaporator and the condenser; and a first water cooling type heat exchanger and a second water cooling type heat exchanger installed within the circulation duct and respectively disposed at an upper stream side and a lower stream side of the evaporator with respect to an air movement direction in order to dehumidify air passing through the evaporator, includes: measuring a feed water temperature supplied to the first water cooling type heat exchanger and the second water cooling type heat exchanger and an evaporation temperature of the evaporator; and comparing the feed water temperature and the evaporation temperature and selectively supplying water to the first water cooling type heat exchanger and the second water cooling type heat exchanger according to the feed water temperature to dehumidify air passing through the evaporator.

According to an example in relation to the present disclosure, in the dehumidifying air, the water is supplied to the second water cooling type heat exchanger and subsequently supplied to the first water cooling type heat exchanger, to thereby dually dehumidify air passing through the evaporator.

According to an example in relation to the present disclosure, the method may further include: measuring evaporation pressure of the evaporator and condensing pressure of the condenser; and comparing the evaporation pressure and the condensing pressure with reference pressure and controlling operations of the first water cooling type heat exchanger and the second water cooling type heat exchanger.

To achieve these and other advantages and in accordance with the purpose of this specification, as embodied and broadly described herein, a method for controlling clothes treating apparatus including: a drum configured to accommodate a target dry item; a circulation duct configured to form an air circulation flow channel allowing air to circulate therein by way of the drum; a heat pump cycle configured to have an evaporator and a condenser disposed to be spaced apart from one another within the circulation duct, and absorb heat of air released from the drum through the evaporator and transmit the absorbed heat to air introduced to the drum through the condenser, by using a working fluid circulating by way of the evaporator and the condenser; and a first water cooling type heat exchanger and a second water cooling type heat exchanger installed within the circulation duct and respectively disposed at an upper stream side and a lower stream side of the evaporator with respect to an air movement direction in order to dehumidify air passing through the evaporator, includes: supplying water to the first water cooling type heat exchanger to dehumidify air passing through the evaporator; and moving water discharged from the first water cooling type heat exchanger to the second water cooling type heat exchanger to heat air passing through the evaporator.

To achieve these and other advantages and in accordance with the purpose of this specification, as embodied and broadly described herein, a method for controlling clothes treating apparatus including: a drum configured to accommodate a target dry item; a circulation duct configured to form an air circulation flow channel allowing air to circulate therein by way of the drum; a heat pump cycle configured to have an evaporator and a condenser disposed to be spaced apart from one another within the circulation duct, and absorb heat of air released from the drum through the evaporator and transmit the absorbed heat to air introduced to the drum through the condenser, by using a working fluid circulating by way of the evaporator and the condenser; and a first air cooling type heat exchanger and a second air cooling type heat exchanger installed within the circulation duct and respectively disposed at an upper stream side and a lower stream side of the evaporator with respect to an air movement direction in order to dehumidify air passing through the evaporator, includes: measuring evaporation pressure of the evaporator and condensing pressure of the condenser; supplying ambient air to the first air cooling type heat exchanger to dehumidify air introduced to the evaporator; and comparing at least one of the evaporation pressure and the condensing pressure to exhaust ambient air from the first air cooling type heat exchanger to the outside or move ambient air discharged from the first air cooling type heat exchanger to the second air cooling type heat exchanger so as to be re-used to heat air which has passed through the evaporator according to the measured pressure.

According to embodiments of the present disclosure, dehumidifying capability of the evaporator may be enhanced directly through the heat exchangers respectively disposed at the upper stream side (front stage) and the lower stream side (rear stage) of the evaporator, and an amount of heat that the evaporator of the refrigerant cycle cannot handle sufficiently within the system is actively handled by the heat exchangers, thereby preventing the refrigerant cycle from being increased in the upward or rightward/upward direction in a pressure enthalpy mollier diagram.

Also, since the increase in the refrigerant cycle on the pressure enthalpy mollier diagram does not always hamper enhancement of dry performance of the dryer, the heat exchangers installed at the front and rear stages of the evaporator may be selectively operated in a case in which a condition that evaporation pressure and condensing pressure of a refrigerant cycle or a discharge temperature of the compressor is so high as to cause a problem with reliability of the compressor or a condition that a COP is rapidly reduced is met, thereby contributing to enhancement of performance.

In addition, evaporation pressure and condensing pressure may be maintained at a low level by cooling air at the front stage and the rear stage of the evaporator, stabilizing the refrigerant cycle in terms of reliability. In addition, since an amount of removed moisture is increased, a dry time may be shortened.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method for controlling clothes treating apparatus including a drum configured to accommodate an item for drying, a circulation duct configured to form an air circulation flow channel allowing air to circulate through the drum, a heat pump cycle including an evaporator and a condenser disposed to be spaced apart from one another within the circulation duct, the heat pump cycle being configured to absorb heat of air released from the drum through the evaporator and transmit the absorbed heat to air introduced to the drum through the condenser, by using a working fluid circulating by way of the evaporator and the condenser, and a first water cooling type heat exchanger and a second water cooling type heat exchanger installed within the circulation duct, the first water cooling type heat exchanger being disposed upstream relative to the evaporator and the second water cooling type heat exchanger disposed downstream relative to the evaporator with respect to a direction of airflow through the evaporator in order to dehumidify air passing through the evaporator, the method comprising:

supplying water to the first water cooling type heat exchanger to dehumidify air passing through the evaporator; and moving water discharged from the first water cooling type heat exchanger to the second water cooling type heat exchanger to heat air passing through the evaporator.

2. A method for controlling a clothes treating apparatus including a drum configured to accommodate an item for drying, a circulation duct configured to form an air circulation flow channel that allows air to circulate through the drum, a heat pump cycle including an evaporator and a condenser disposed to be spaced apart from one another within the circulation duct, the heat pump cycle being configured to absorb heat of air released from the drum through the evaporator and transmit the absorbed heat to air introduced to the drum through the condenser, by using a working fluid that circulates by way of the evaporator and the condenser, and a first water cooling type heat exchanger and a second water cooling type heat exchanger installed within the circulation duct, the first water cooling type heat exchanger being disposed upstream relative to the evaporator and the second water cooling type heat exchanger disposed downstream relative to the evaporator with respect to a direction of airflow through the evaporator in order to dehumidify air passing through the evaporator, the method comprising:

measuring a feed water temperature supplied to the first water cooling type heat exchanger and the second water cooling type heat exchanger and an evaporation temperature of the evaporator; and comparing the feed water temperature and the evaporation temperature, and selectively supplying water to the first water cooling type heat exchanger and the second water cooling type heat exchanger according to a comparison between the feed water temperature and the evaporation temperature in order to dehumidify air passing through the evaporator.

3. The method of claim 2, wherein, in dehumidifying air passing through the evaporator, the water is supplied to the second water cooling type heat exchanger and subsequently supplied to the first water cooling type heat exchanger such that the first and second water cooling type heat exchangers are used to dehumidify air passing through the evaporator.

4. The method of claim 2, further comprising:

measuring an evaporation pressure of the evaporator and a condensing pressure of the condenser; and comparing the evaporation pressure and the condensing pressure with a reference pressure and controlling operations of the first water cooling type heat exchanger and the second water cooling type heat exchanger based on the comparison.

5. A clothes treating apparatus comprising:

a case;

a drum installed within the case and configured to accommodate an item for drying;

a circulation duct configured to form an air circulation flow channel that allows air to circulate through the drum;

a heat pump cycle including an evaporator and a condenser disposed to be spaced apart from one another within the circulation duct, the heat pump cycle being configured to absorb heat of air released from the drum through the evaporator and transmit the absorbed heat to air introduced to the drum through the condenser, by using a working fluid that circulates by way of the evaporator and the condenser;

a first water cooling type heat exchanger and a second water cooling type heat exchanger installed within the circulation duct, the first water cooling type heat exchanger being disposed upstream relative to the evaporator and the second water cooling type heat exchanger disposed downstream relative to the evaporator with respect to a direction of airflow through the evaporator in order to dehumidify air passing through the evaporator in the circulation duct;

a first temperature sensor configured to measure a feed water temperature supplied to the first water cooling type heat exchanger and the second water cooling type heat exchanger;

a second temperature sensor configured to measure an evaporation temperature of the evaporator; and a controller configured to selectively supply water to the first water cooling type heat exchanger and the second water cooling type heat exchanger according to a comparison between the feed water temperature and the evaporation temperature.

6. The clothes treating apparatus of claim 5, further comprising:

a water supply device configured to supply water to the first water cooling type heat exchanger and the second water cooling type heat exchanger;

a water feed pipe configured to form a water feed flow channel to allow the water from the water supply device to be supplied to the first water cooling type heat exchanger and the second water cooling type heat exchanger; and a drain pipe configured to form a drain flow channel to allow the water to be discharged from the first water cooling type heat exchanger and the second water cooling type heat exchanger.

7. The clothes treating apparatus of claim 6, further comprising:

a water reservoir that stores water drained from the drain pipe.

8. The clothes treating apparatus of claim 6, wherein the first temperature sensor is installed at the water feed pipe, the second temperature sensor is installed at the evaporator, and a three way valve is installed at the water feed pipe.

9. The clothes treating apparatus of claim 8, wherein the heat pump cycle comprises:

a first pressure sensor installed at the evaporator and configured to sense evaporation pressure of the evaporator; and a second pressure sensor installed at the condenser and configured to sense condensing pressure of the condenser, wherein the controller compares at least one of the evaporation pressure and the condensing pressure with a reference pressure, and controls operations of the first water cooling type heat exchanger and the second water cooling type heat exchanger according to the evaporation pressure or the condensing pressure.

10. The clothes treating apparatus of claim 8, wherein the controller compares the feed water temperature and the evaporation temperature, and controls the three way valve according to the comparison between the feed water temperature and the evaporation temperature to selectively supply water to the first water cooling type heat exchanger and the second water cooling type heat exchanger.

11. The clothes treating apparatus of claim 6, wherein the drain pipe includes a first drain pipe connected to the first water cooling type heat exchanger and a second drain pipe connected to the second water cooling type heat exchanger, and water from each of the first water cooling type heat exchanger and the second water cooling type heat exchanger is independently drained.

12. The clothes treating apparatus of claim 6, further comprising a connection pipe that connects the first water cooling type heat exchanger and the second water cooling type heat exchanger to allow a coolant discharged from the second water cooling type heat exchanger to be introduced to the first water cooling type heat exchanger so as to be re-used.

13. The clothes treating apparatus of claim 12, wherein the water feed pipe includes:

a main water feed pipe connected to the water supply device; and a plurality of branch pipes that branch from the main water feed pipe and configured to form branch flow channels that allows the water to be supplied to the first water cooling type heat exchanger and the second water cooling type heat exchanger, respectively, wherein a first branch pipe among the plurality of branch pipes is connected to the first water cooling type heat exchanger and extends to connect the connection pipe such that the water is supplied to the first water cooling type heat exchanger by way of the connection pipe.

14. A clothes treating apparatus comprising:

a case;

a drum installed within the case and configured to accommodate an item for drying;

a circulation duct configured to form an air circulation flow channel that allows air to circulate through the drum;

a heat pump cycle including an evaporator and a condenser disposed to be spaced apart from one another within the circulation duct, the heat pump cycle being configured to absorb heat of air released from the drum through the evaporator and transmit the absorbed heat to air introduced to the drum through the condenser, by using a working fluid that circulates by way of the evaporator and the condenser;

a first air cooling type heat exchanger and a second air cooling type heat exchanger installed within the circulation duct, the first air cooling type heat exchanger being disposed upstream relative to the evaporator and the second air cooling type heat exchanger being disposed downstream relative to the evaporator with respect to a direction of airflow through the evaporator;

an intake pipe configured to form an intake flow channel to allow air outside the case to be introduced to the first air cooling type heat exchanger therethrough;

a fan installed at the intake pipe and configured to generate airflow through the intake pipe to the first air cooling type heat exchanger;

a plurality of exhaust pipes respectively installed at the first air cooling type heat exchanger and the second air cooling type heat exchanger and configured to form an exhaust flow channel to allow air from the first air cooling type heat exchanger and the second air cooling type heat exchanger to be exhausted outside the case; and a connection duct configured to connect the first air cooling type heat exchanger and the second air cooling type heat exchanger to allow air discharged from the first air cooling type heat exchanger to be introduced to the second air cooling type heat exchanger so as to be re-used.

15. The clothes treating apparatus of claim 14, wherein the heat pump cycle includes:

a first pressure sensor installed at the evaporator and configured to sense evaporation pressure of the evaporator; and a second pressure sensor installed at the condenser and configured to sense condensing pressure of the condenser, wherein a controller is configured to compare at least one of the evaporation pressure and the condensing pressure with a reference pressure, and controls operations of the first air cooling type heat exchanger and the second air cooling type heat exchanger according to the evaporation pressure or the condensing pressure.

16. The clothes treating apparatus of claim 15, wherein the controller controls a flow rate of air introduced to the second air cooling type heat exchanger by controlling air exhausted through the first air cooling type heat exchanger or by adjusting a degree of opening of the connection duct according to the evaporation pressure or the condensing pressure.

17. The clothes treating apparatus of claim 14, further comprising:

an air damper rotatably installed in the connection duct to open and close the connection duct.

18. The clothes treating apparatus of claim 14, wherein the connection duct is formed to be branched from a first exhaust pipe connected to the first air cooling type heat exchanger, among the plurality of exhaust pipes.

19. A clothes treating apparatus comprising:

a case;

a drum installed within the case and configured to accommodate an item for drying;

a circulation duct configured to form an air circulation flow channel that allows air to circulate through the drum;

a heat pump cycle including an evaporator and a condenser disposed to be spaced apart from one another within the circulation duct, the heat pump cycle being configured to absorb heat of air released from the drum through the evaporator and transmit the absorbed heat to air introduced to the drum through the condenser, by using a working fluid that circulates by way of the evaporator and the condenser;

a first water cooling type heat exchanger and a second water cooling type heat exchanger installed within the circulation duct, the first water cooling type heat exchanger being disposed upstream relative to the evaporator and the second water cooling type heat exchanger disposed downstream relative to the evaporator with respect to a direction of airflow through the evaporator in order to dehumidify air passing through the evaporator in the circulation duct;

a water supply device configured to supply water to the first water cooling type heat exchanger and the second water cooling type heat exchanger;

a water feed pipe is connected to the first water cooling type heat exchanger to allow the water from the water supply device to be supplied to the first water cooling type heat exchanger;

a connection pipe connecting the first water cooling type heat exchanger with the second water cooling type heat exchanger to allow water discharged from the first water cooling type heat exchanger to be introduced to the second water cooling type heat exchanger so as to be re-used; and a drain pipe connected to the second water cooling type heat exchanger to discharge water from the second water cooling type heat exchanger.

20. A method for controlling clothes treating apparatus including a drum configured to accommodate an item for drying, a circulation duct configured to form an air circulation flow channel that allows air to circulate through the drum, a heat pump cycle including an evaporator and a condenser disposed to be spaced apart from one another within the circulation duct, the heat pump cycle being configured to absorb heat of air released from the drum through the evaporator and transmit the absorbed heat to air introduced to the drum through the condenser, by using a working fluid circulating by way of the evaporator and the condenser, and a first air cooling type heat exchanger and a second air cooling type heat exchanger installed within the circulation duct, the first air cooling type heat exchanger being disposed upstream relative to the evaporator and the second air cooling type heat exchanger disposed downstream relative to the evaporator with respect to a direction of airflow through the evaporator in order to dehumidify air passing through the evaporator, the method comprising:

measuring an evaporation pressure of the evaporator and a condensing pressure of the condenser;

supplying ambient air to the first air cooling type heat exchanger to dehumidify air introduced to the evaporator; and comparing at least one of the evaporation pressure and the condensing pressure with a reference pressure to exhaust the ambient air from the first air cooling type heat exchanger or move the ambient air discharged from the first air cooling type heat exchanger to the second air cooling type heat exchanger so as to be re-used to heat air which has passed through the evaporator according to the evaporation pressure or the condensing pressure.

* * * * *